United States Patent [19]

Niederer

[11] Patent Number: 5,050,816

[45] Date of Patent: Sep. 24, 1991

[54] STRAND TENSION CONTROLLER

[75] Inventor: Kurt W. Niederer, Charlotte, N.C.

[73] Assignee: Belmont Textile Machinery Co., Inc., Belmont, N.C.

[21] Appl. No.: 494,154

[22] Filed: Mar. 14, 1990

[51] Int. Cl.[5] ..... B65H 59/24

[52] U.S. Cl. ..... 242/149; 242/131

[58] Field of Search ..... 242/149, 150 R, 150 M, 242/151, 152.1, 153, 154, 155 R, 155 M, 155 BW, 131, 131.1, 129.8, 147 R

[56] References Cited

U.S. PATENT DOCUMENTS

| | | | |
|---|---|---|---|
| 274,822 | 3/1883 | Remy . | |
| 396,907 | 1/1889 | Wilcomb . | |
| 398,127 | 2/1989 | Calley . | |
| 642,698 | 2/1900 | Iveson . | |
| 745,123 | 11/1903 | Tuseth . | |
| 1,356,026 | 10/1920 | Veilleux et al. . | |
| 2,348,856 | 12/1942 | Selvig | 242/149 |
| 2,630,836 | 3/1953 | Cole | 139/13 |
| 2,646,943 | 7/1953 | Lindsay | 242/150 |
| 2,656,125 | 10/1953 | O'Dell | 242/45 |
| 2,750,130 | 6/1956 | Heizer, et al. | 242/149 |
| 2,888,216 | 5/1959 | Simons, Jr. et al. | 242/149 X |
| 2,981,497 | 4/1961 | Schurich | 242/149 |
| 3,937,417 | 2/1976 | Guenther | 242/147 |

FOREIGN PATENT DOCUMENTS

| | | | |
|---|---|---|---|
| 4413 | 2/1970 | Japan | 242/149 |

*Primary Examiner*—Stanley N. Gilreath

*Attorney, Agent, or Firm*—W. Thad Adams, III

[57] ABSTRACT

A strand tension controller which has an elongate strand sensing lever arm having a strand guiding input end and an opposing strand guiding output end with a tension shoe positioned between the input end and the output end of the lever arm for applying tension between a range of zero and a preset maximum tension on the strand. The lever arm is pivoted adjacent the strand engaging output end pivotal movement responsive to strand tension sensed at the opposing strand engaging input end of the lever arm and for subtracting from the tension applied by the tension shoe. The tension is sensed on the strand at the input end of the lever arm. The tension shoe engages a first surface of the lever arm and the strand passes along the top surface of the lever arm from the input to the output end of the lever arm. A pressure responsive expandable fluid reservoir in the form of an air tube controls the force applied to the strand.

26 Claims, 7 Drawing Sheets

STRAND TENSION CONTROLLER

TECHNICAL FIELD AND BACKGROUND OF THE INVENTION

This invention relates to a strand tension controller. The invention has application in many types of strand processes where the strand is moving and the tension on the moving strand affects some downstream process being carried out on the strand. The embodiment disclosed in this application relates to a yarn tension controller useful for controlling tension on textile yarn processing machines such as, for example, winders and twisters. Processing yarn on these types of machines require careful control of tension because of the effect of yarn tension on dyeing characteristics and the ability of the yarn to properly react to processing steps such as air entangling and heat setting. Scientific study suggests that there is an ideal tension at which any particular yarn should be delivered to any given process. The closer to that ideal the actual processing approaches, the better the processed yarn. Scientific study has also demonstrated that the more uniform the tension at any given desired tension level, the more uniform the processed yarn.

Numerous types are devices are known for controlling yarn tension. These include devices as simple as merely applying weights such as metal disks to guides through which the yarn passes to add sufficient tension to dampen tension variations.

U.S. Pat. No. 3,937,417 discloses a yarn tension apparatus which accepts "essentially tensionless yarn" and progressively adds tension over a series of relatively long surfaces to "accommodate the abrupt fluctuations associated with tangle release events." As is made clear in this patent, the device is directed more towards adding tension and dampening any abrupt variations in the tension than in providing a uniform predetermined output tension on the yarn, even though a claim of uniform yarn tension is made. See, col. 4, 1. 13–16.

The Schurich U.S. Pat. No. 2,981,497 discloses a thread tensioner which includes a dancer arm which takes up slack in thread caused by the reciprocating movement of a hand-operated knitting machine. The dancer arm includes a pivot and a pair of brake plates adjacent the thread input end of the dancer arm which moves downward at its free end when a thick place, such as a knot, passes between the brake plates. The downward movement of the dancer arm weakens the braking action so that the knot can slip through more easily. Of course, the tension on the yarn is affected. It is clear, however, that major result is to vary the tension on the thread backwards through the thread path, not forward towards the knitting machine. While the slack may be taken up by the dancer arm movement, uniform tension is not achieved. Rather, the oscillation of the tension is dampened.

This is a subtle but important point. The object in controlling tension is to present to the yarn processing station a desired tension, and to present that desired tension uniformly on a real time basis. "Average" tension over time does not result in a suitable quality yarn over time. Yet most prior art tension devices are concerned mainly with dampening the amplitude of yarn variation by working backwards through the system to produce a yarn with a suitable "average" tension.

The invention disclosed in this application is the result of mathematical analysis which demonstrates that with the proper lever ratio tension can be "subtracted" from a pre-set tension working forward through a yarn path to output to a yarn processing station such as a heat setting device a yarn having a uniform, desired tension.

As a further refinement on the principle of outputting a uniformly tensioned yarn at a single station, a method and apparatus for controlling the uniformity and tension level of every yarn on a yarn processing machine has been devised and is also disclosed.

SUMMARY OF THE INVENTION

Therefore, it is an object of the invention to provide a strand tension controller for maintaining uniform tension on a yarn for delivery to a yarn processing station.

It is another object of the invention to provide a strand tension controller which delivers a strand at a predetermined tension level to a yarn processing station.

It is another object of the invention to provide a strand tension controller which controls the tension level and tension uniformity forward instead of backwards along the yarn path.

It is another object of the invention to provide a yarn processing machine which achieves the objects set out above.

It is another object of the invention to provide a strand tension controller which includes means for uniformly and simultaneously setting and varying the strand tension on a plurality of strands being processed.

These and other objects of the present invention are achieved in the preferred embodiments disclosed below by providing a strand tension controller, comprising an elongate strand sensing lever arm having a strand guiding input end and an opposing strand guiding output end with friction means positioned between the input end and the output end of the lever arm for applying tension between a range of zero and a preset maximum tension on the strand. Tension subtraction means are provided adjacent the stand engaging output end for mounting the lever arm for pivotal movement responsive to strand tension sensed at the opposing strand engaging input end of the lever arm and for subtracting from the tension applied by the friction means the tension sensed on strand at the input end of the lever arm.

According to one preferred embodiment of the invention, the friction means comprises a tension shoe for engaging a first surface of the lever arm and the strand passing along the top surface of the lever arm from the input to the output end of the lever arm. Force means cooperate with a second, opposing surface of the lever arm for urging the lever arm against the tension shoe.

According to another preferred embodiment of the invention, the force means comprises a pressure responsive expandable fluid reservoir.

According to yet another preferred embodiment of the invention, the fluid reservoir comprises a tube and includes pressure adjusting means for adjusting the pressure within the reservoir.

Preferably, the fluid comprises air.

According to one preferred embodiment of the invention, spacing means are positioned between the fluid reservoir and the lever arm.

According to another preferred embodiment of the invention, tension range adjustment means are provided for adjusting the range of tension applied by the friction means.

According to yet another preferred embodiment of the invention, the lever ratio adjustment comprises spacing means for positioning the tension shoe in a predetermined position from the pivoted tension subtraction means.

According to one preferred embodiment of the yarn processing machine of the invention, a creel is provided for holding a plurality of yarn packages in position to dispense yarn and a plurality of yarn processing stations are provided for performing a predetermined process on the yarn dispensed from the creel. A plurality of take-up stations downstream from the yarn processing stations are provided for holding a yarn take-up package to receive processed yarn and a like plurality of yarn tension controllers are positioned downstream from the creel and upstream from the yarn processing stations for controlling tension of yarn delivered to the yarn processing stations.

Each of the yarn tension controllers comprise an elongate yarn sensing lever arm having a yarn guiding input end and an opposing yarn guiding output end, friction means positioned between the input end and the output end of the lever arm for applying tension between a range of zero and a preset maximum tension on the yarn, and tension subtraction means adjacent the stand engaging output end for mounting the lever arm for pivotal movement responsive to yarn tension sensed at the opposing yarn engaging input end of the lever arm and for subtracting from the tension applied by the friction means the tension sensed on yarn at the input end of the lever arm.

According to one preferred embodiment of the invention, the friction means comprises a tension shoe for engaging a first surface of the lever arm and the yarn passing along the top surface of the lever arm from the input to the output end of the lever arm, and force means for cooperating with a second, opposing surface of the lever arm for urging the lever arm against the tension shoe.

Preferably, the force means comprises a pressure responsive expandable fluid reservoir and the fluid reservoir comprises a tube and includes pressure adjusting means for adjusting the pressure within the reservoir.

Preferably, the fluid comprises air.

According to another preferred embodiment of the invention, spacing means are positioned between the fluid reservoir and the lever arm.

According to yet another preferred embodiment of the invention, lever ratio adjustment means are provided for adjusting the range of tension applied by the friction means.

Preferably, the lever ratio adjustment means comprises spacing means for positioning the tension shoe in a predetermined position from the pivoted tension subtraction means.

According to one preferred embodiment of the invention, the air tube extends to the plurality of yarn tension controllers for simultaneously and uniformly controlling the force applied to the yarn at each of the plurality of yarn tension controllers by the tension shoe.

According to another preferred embodiment of the invention, a yarn processing machine is provided which includes a creel for holding a plurality of yarn packages in position to dispense yarn, a plurality of yarn processing stations for performing a predetermined process on the yarn dispensed from the creel, a plurality of take-up stations downstream from the yarn processing stations for holding a yarn take-up package to receive processed yarn and a plurality of yarn tension controllers positioned downstream from the creel and upstream from the yarn processing stations for controlling tension of yarn delivered to the yarn processing stations.

Each of the yarn tension controllers comprises a mounting tube mounted transverse to the direction of yarn travel from the creel to the yarn processing station and has an access opening therein. An expandable elongate air tube is positioned through the mounting tube and extends along at least part of the length of the yarn processing machine and has air pressure adjustment means for simultaneously and uniformly controlling air pressure within the air tube and therefore the expansion of the tube in response to the air pressure.

A housing having an access opening therein is provided, the housing mounted on the mounting tube with the access opening therein in communication with the access opening in the mounting tube. A lever arm is pivotally mounted in the housing in communication with the access opening in the housing and in communication with the mounting tube and having a first major surface for being engaged by the air tube. The lever arm has a second major surface along which the yarn passes. The lever arm also has a yarn engaging yarn input end and an opposing yarn engaging yarn output end, the lever arm being pivotally mounted adjacent the yarn output end. A tension shoe is carried by the housing for engaging the second major surface of the lever arm intermediate the output end and the point of engagement by the air tube. The engagement by the tension shoe is in correlation to the force applied by the air tube to the first major surface of the lever arm, whereby an increase in input tension on the yarn results movement of the lever arm away from the tension shoe and therefore subtraction of tension from the yarn.

Preferably, the lever arm includes wear-resistant yarn guides on the input and output ends thereof.

According to one preferred embodiment of the invention, a yarn threading slot is provided in the housing for receiving a yarn therethrough from the input to the output end thereof.

An embodiment of the method according to the invention comprises the steps of providing a creel, a strand processing station downstream from the creel and a strand take-up station downstream from the strand processing station, and applying a maximum desired pre-set tension to the strand between the creel and the strand processing station. The tension on the strand from the creel is sensed before application of the pre-set tension to the strand and the tension on the strand from the creel is subtracted from the maximum pre-set tension upstream from the strand processing station to maintain the maximum desired pre-set tension on the strand at the strand processing station.

Preferably, the step of applying a maximum desired pre-set tension to the strand comprises applying friction to the strand in correlation to expansion of an fluid filled pressure reservoir.

According to another preferred embodiment of the invention, the step of providing a creel, a strand processing station downstream from the creel and a strand take-up station downstream from the strand processing station comprises the step of providing a plurality of yarn creels, a plurality of yarn processing stations and a plurality of yarn take-up stations downstream from the yarn processing station for processing a plurality of yarn strands, and the strand processing machine comprises a textile yarn processing machine.

According to yet another preferred embodiment of the invention the step of applying a maximum desired pre-set tension to the yarn between the creel and the yarn processing station comprises applying the tension from a single fluid filled pressure reservoir to each of the yarn strands uniformly and simultaneously.

According to yet another preferred embodiment of the invention, the fluid comprises air and the pressure reservoir comprises an elongate air tube extending from a single air source along the yarn processing machine from one end to the other end.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
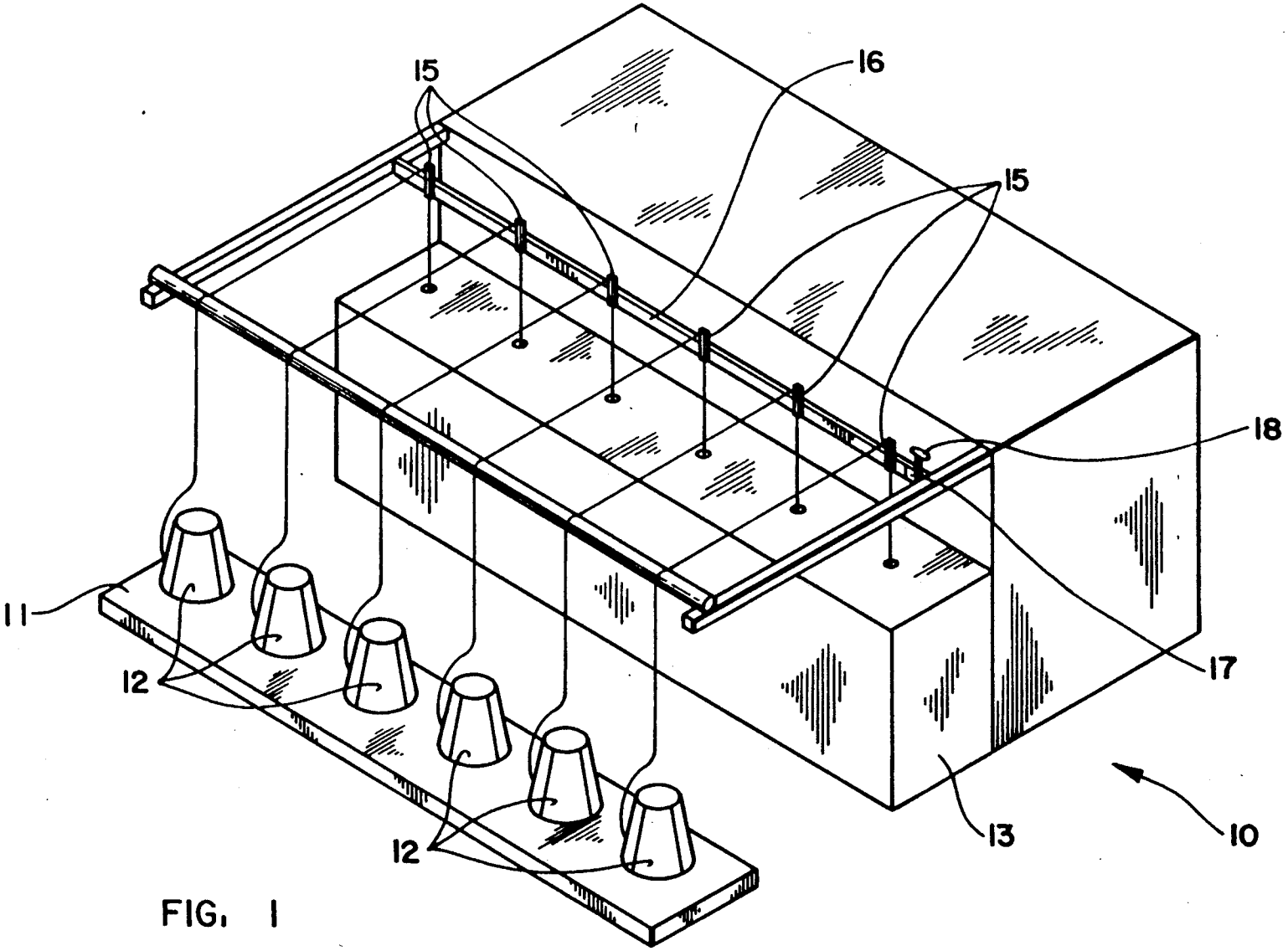
FIG. 1 is a perspective view of a yarn processing machine according to one embodiment of the invention.

Referring now specifically to the drawings, a yarn processing machine, in particular a textile yarn winder, according to the present invention is illustrated in FIG. 1 and shown generally at reference numeral 10. While the invention has application to many types of strand processing machines where accurate control of the level and uniformity of tension is desireable, for purposes of describing the invention and the best mode for practicing the invention, reference will be made throughout to a textile yarn winder of the type shown in FIG. 1. The particular process being performed on the yarn may vary, and may include air-jet entangling, false-twisting, heat setting among others.

Figure 2:
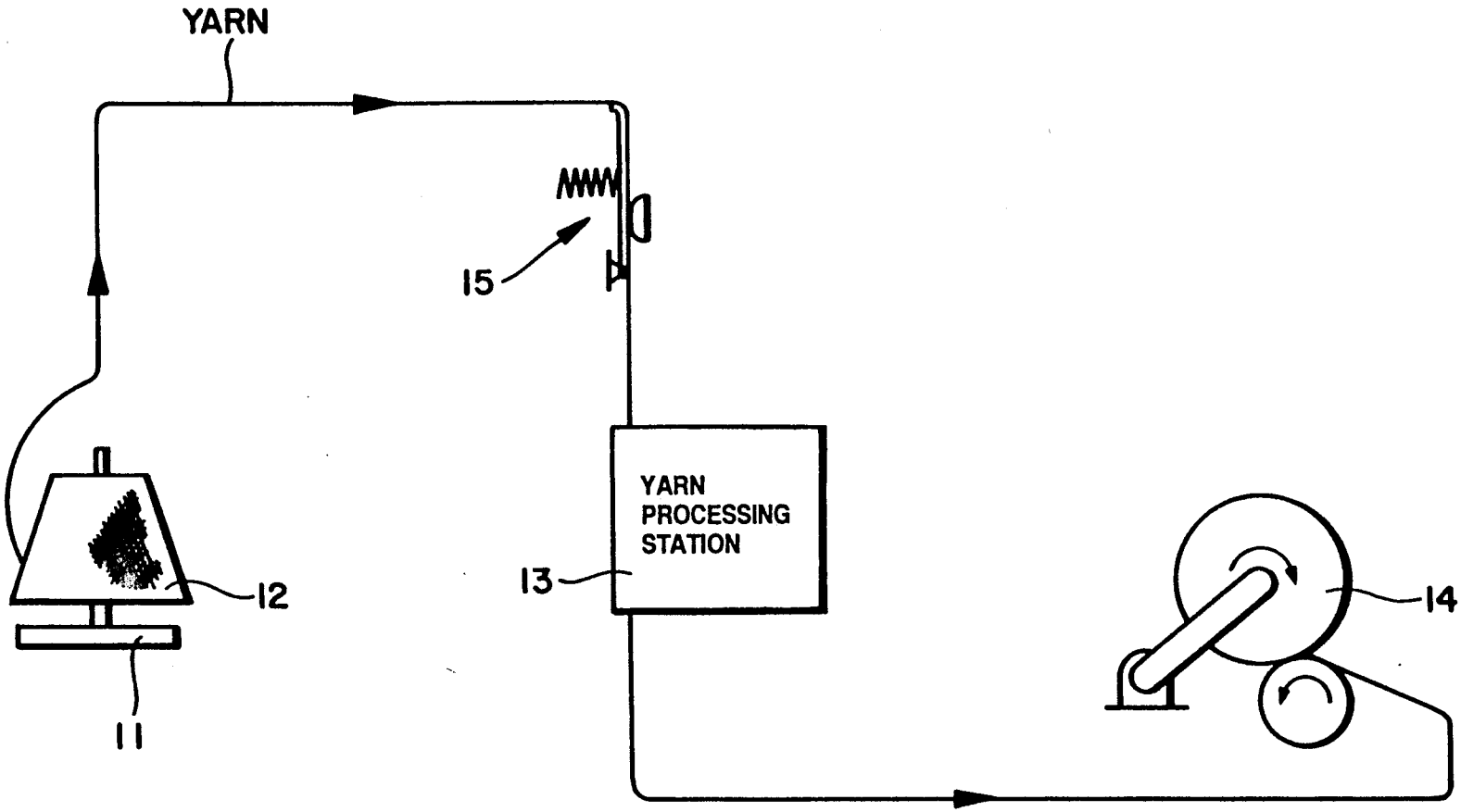
FIG. 2 is a schematic view of one yarn path on a yarn processing machine such as shown in FIG. 1.

As is shown in FIG. 1, each position of winder 10 includes a plurality of yarn processing positions for processing a single yarn or group of yarns. As is best shown in FIG. 2, each processing position includes a creel 11 for holding a supply package of yarn 12 which is delivered to a yarn processing station 13 which may perform any known type of process on the yarn. The processed yarn is then wound onto a take-up yarn package 14 such as a bobbin.

Still referring to FIGS. 1 and 2, a yarn tension controller 15 is shown. Yarn tension controller 15 is positioned downstream in the yarn path from creel 11 and upstream from yarn processing station 13, so that constant tension is output to yarn processing station 13. As is described in further detail below, an air tube 16 is supplied with pressurized air from an air supply 17 which includes a pressure regulating valve 18 shown schematically.

Figure 3:
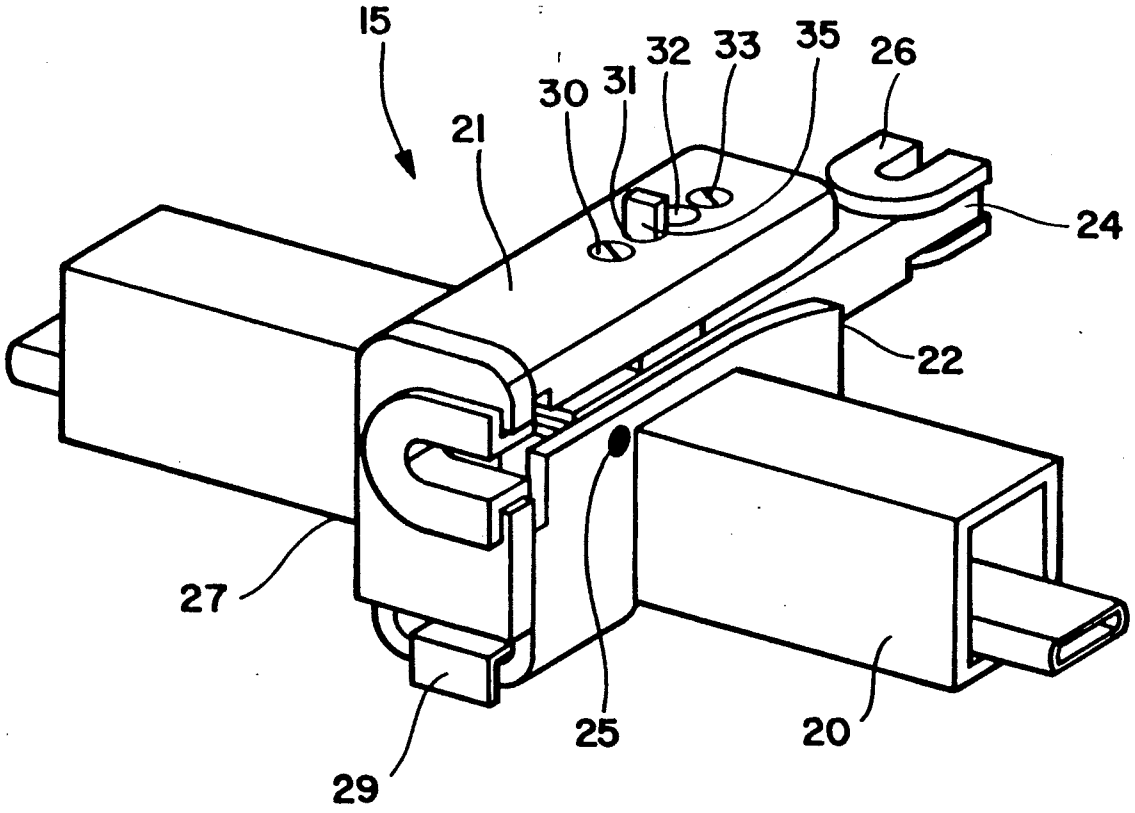
FIG. 3 is a perspective view of a strand tension controller according to one embodiment of the invention.

Yarn tension controller 15 is shown in FIG. 3, and includes a mounting tube 20 through which air tube 16 extends. Air tube 16 can be any suitable plastic hose, such as polyethylene, which expands and contracts in a predictable way in response to increases and decreases in air pressure within the tube. A housing 21 is transversely mounted on mounting tube 20 and includes a thread guide slot 22 which extends the length of the housing 21. A lever arm 24 is pivotally mounted in housing 21 by a pivot pin 25 through the yarn output end of lever arm 24. Yarn guides 26 and 27, such as ceramic guides, are mounted on the input end of lever arm 24 and the output end of housing 21, respectively. The assembly described above is held together by a locking leaf 29. A plurality of spaced-apart lever ratio adjustment holes 30, 31, 32, 33 in the top surface of housing 21 receive a locking tab 35 of a tension shoe 36, as is best shown in FIGS. 4 and 5.

Figure 5:
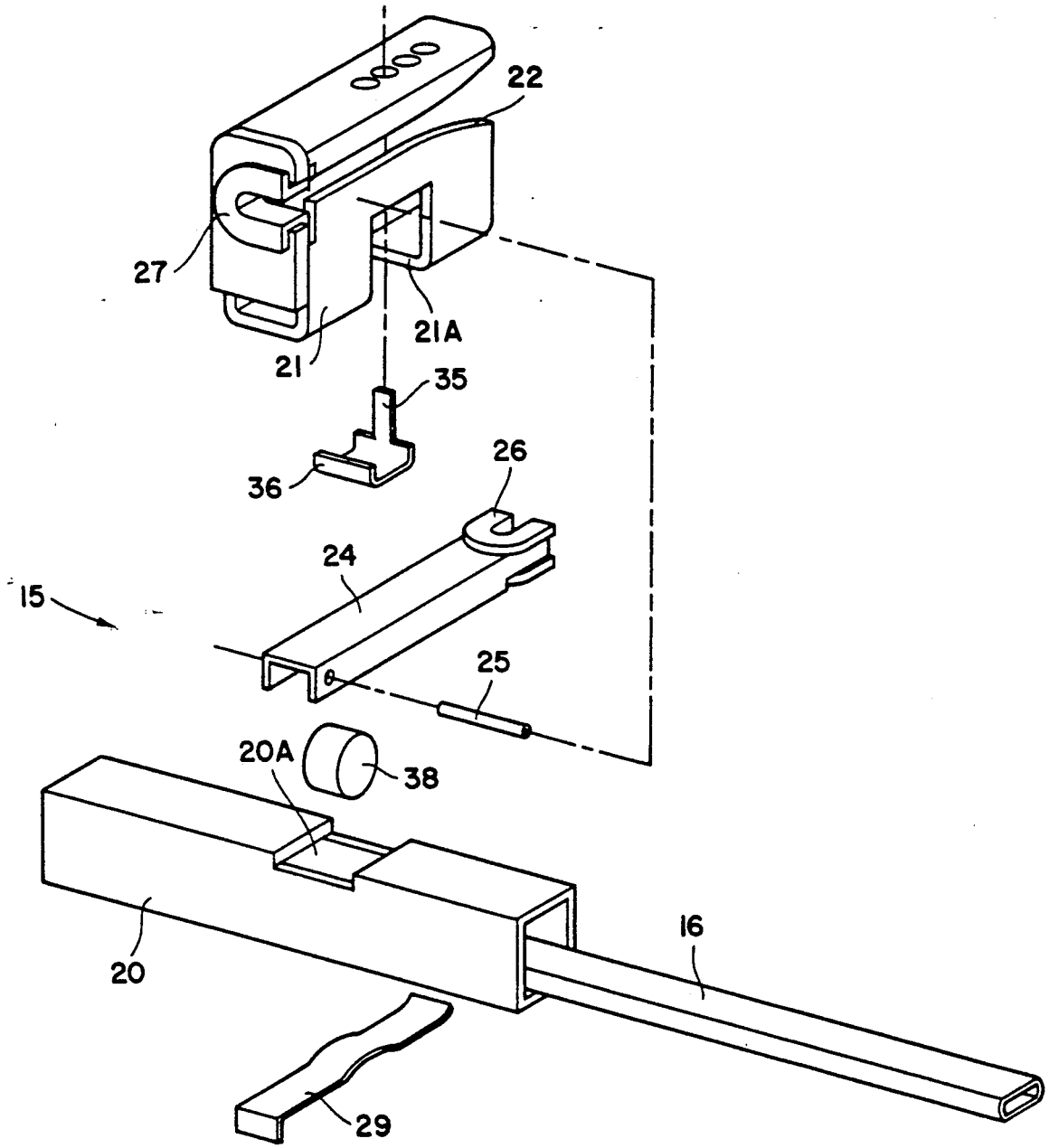
FIG. 5 is an exploded view of the strand tension controller shown in FIG. 3.

Referring now to FIG. 5, it can be seen that mounting tube 20 includes an access opening 20A in the top surface, and that housing 21 includes an access opening 21A in its bottom surface. When housing 21 is properly mounted on mounting tube 20, access openings 20A and 21A mate so that the interior of mounting tube 20 and the interior of housing 21 communicate.

Figure 4:
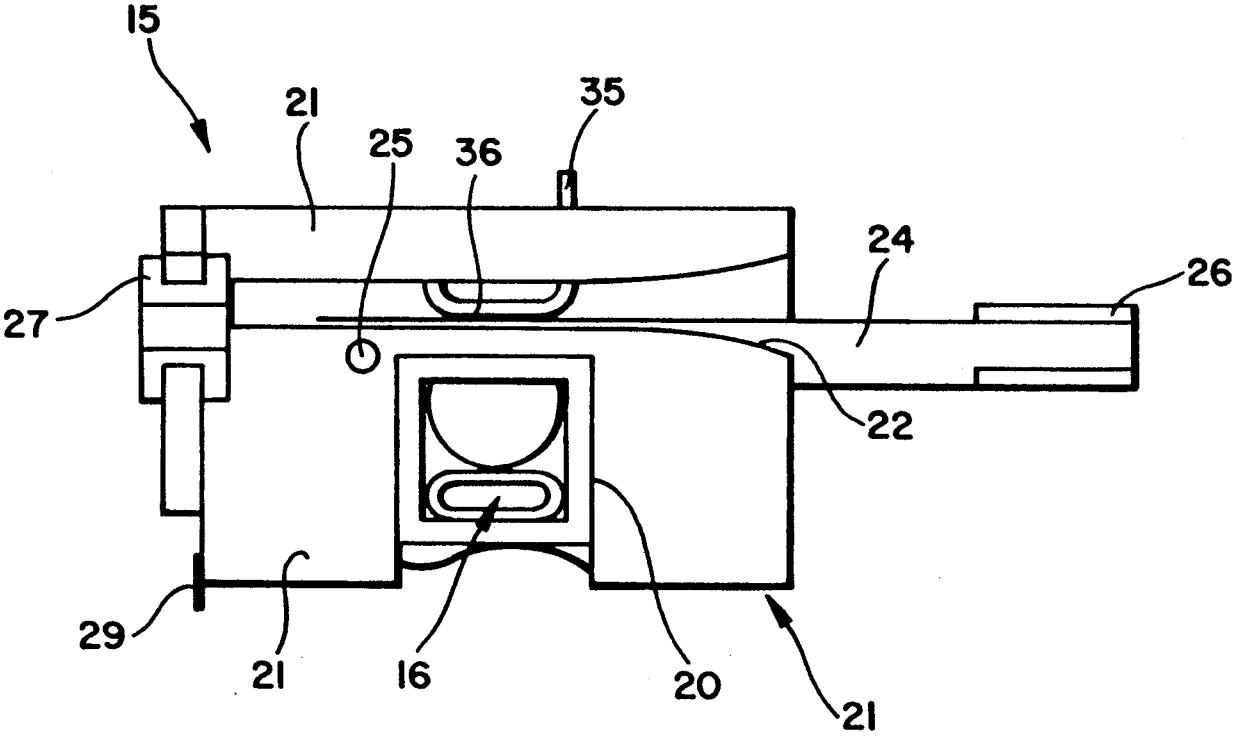
FIG. 4 is a side elevation of the strand tension controller shown in FIG. 3.

Referring now to FIG. 4, the overall assembly of the yarn tension controller 15 can be seen. Housing 21 fits down over mounting tube 20. A disk-like spacer 38 is positioned in mounting tube 20 and rests on the top of air tube 16. The top of spacer 38 engages the underside of lever arm 24 and urges lever arm 24 upwardly into engagement with the bottom surface of shoe 36. The position of shoe 36 depends on which of the lever ratio adjustment holes 30–33 shoe 36 is locked into by locking tab 35. Locking leaf 29 slips through the bottom of housing 21 and a bent portion of locking leaf 29 locks the entire assembly together, as is shown.

In the views described above, it is important to note that the yarn guide 26 is on the input end of lever arm 24, and that lever arm 24 is pivoted on the output end. This is exactly opposite from the usual arrangement of dancer arm tension control devices.

Figure 6:
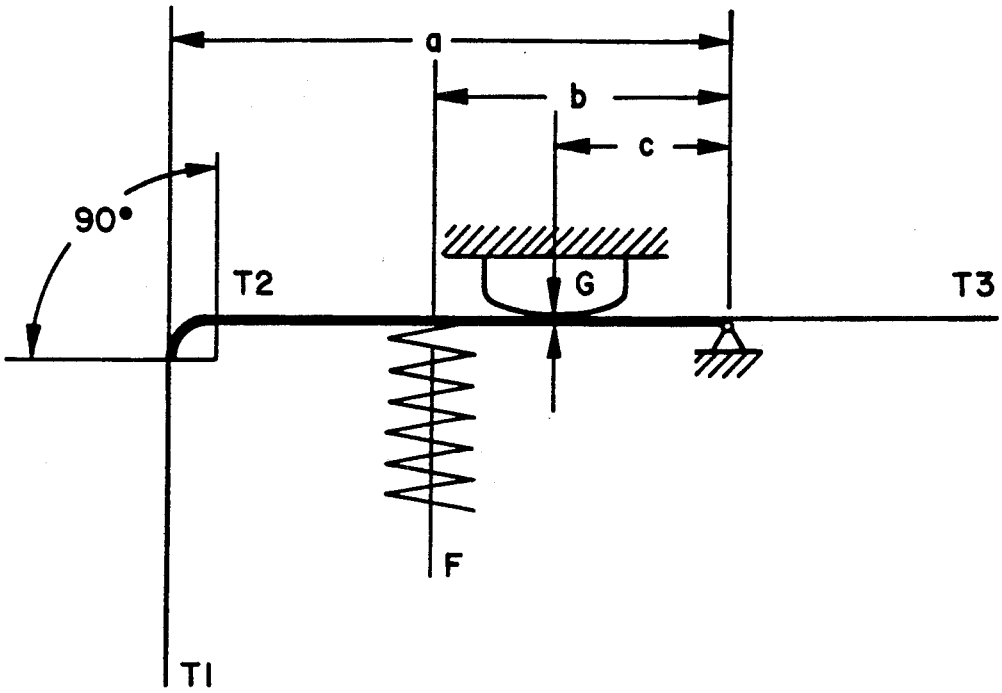
FIG. 6 is a schematic view of the strand tension controller showing a particular tension condition.

Operation of the yarn tension controller 15 can be demonstrated mathematically. FIG. 6 shows yarn tension controller 15 in simplified schematic form. The yarn "Y" coming from creel 11 has a tension "T1." The yarn "Y" leaves yarn tension controller with a tension "T3." "F" represents the pressure applied by air tube 16 to the underside of lever arm 24 at lever-length "b." Tension shoe 36 clamps the yarn strand "Y" with a force "G" and applies a predetermined additional tension to the passing yarn strand "Y."

The creel tension "T1" reduces the applied tension from the tension shoe at "G." If the tension "T1" is zero, the full clamping force "G" generated by the force "F" is applied to the yarn strand "Y." If the yarn strand "Y" is under high tension "T1", it opposes the force "F" and reduces the clamping force correspondingly. The limit of compensation is reached when the "T1" completely offsets the force "F." This limit is reached when the product of $(T1 \times a) = (F \times b)$. The tension shoe 36 should be adjusted as described above according to the formula in the followings calculations.

By properly selecting the lever ratio "a" to "c", the output tension "T3" is not affected by variation in the input tension "T1." In effect, the yarn tension controller filters out or subtracts out tension variations from the creel completely. By sensing the tension and making the necessary adjustments on the input side of the controller, the output tension of the yarn "Y" is completely uniform.

The following calculation proves that the tension can be controlled in the manner described and gives the formula for determining the proper lever ratio:

Legend:

T1=Tension in yarn-strand from creel
T2=Tension in yarn-strand after 90 deg. bend
T3=Tension in yarn-strand leaving device
F=Force for desired tension
G=Clamping force for yarn
a=lever length from pivot to yarn ingress
b=lever length from pivot to applied tension force
c=lever length from pivot to yarn clamp
u1=friction coefficient at 90 deg. bend
u2=friction coefficient at clamp-shoe
u3=friction coefficient at lever, under clamp Calculation:

$$T2=T1\times e^{u1\times\pi/2}$$

$$T3=T2+\{G\times(u2+u3)\}$$

where G=F×b/c−T1×a/c
insert 1) and 3) in 2):

$$T3=T1\times e^{u1\times\pi/2}+F\times b/c\times(u2+u3)-T1\times a/c\times(u2+u3)$$

rewrite 4):

$$T3=T1\times\{e^{u2\times\pi/2}-a/c\times(u2+u3)\}+F\times b/c\times(u2+u3)$$

if changes in the input-tension (T1) should not affect the out-put tension (T3), then the factor "{e−a/c×(u2+u3)}" has to be zero:

$$\{e^{u1\times\pi/2}-a/c\times u2+u3)\}=0$$

rewrite 6):

$$e^{u1\times\pi/2}=a/c\times(u2+u3)$$

from 7) we can deduct the required lever ratio c/a for the self-compesenating tension device:

$$c/a=(u2+u3)/e^{u1\times\pi/2}$$

Use of the formula set out above is demonstrated in an example in which the following values are assumed:

Example:

T1=80 gram
T2=to be calculated
T3=160 gram
F=to be calculated
a=100 mm
b=50 mm
c=to be calculated
u1=0.3
u2=0.25
u3=0.22

Calculation:

1) Lever-ratio $$c/a=(u2+u3)/e^{u1\times\pi/2}=(0.25+0.22)/e^{u1\times\pi/2}=0.2934$$

$$c=0.2934\times a=0.2934\times 100\text{ mm}=29.34\text{ mm}$$

2) Force "F":
from 5)

$$T3=T1\times\{e^{u1\times\pi/2}-a/c\times(u2+u3)+F\times b/c\times(u2+u3)$$

$$160\text{ gram}=t1\times\{e^{0.47}-100\text{ mm}/29./34\text{ mm}\times(0.25+0.22)\}+F\times 50\text{ mm}/100\text{ mm}\times(0.25+0.22)=?$$

the calculation shows that:

$$T1\times\{e^{0.47}-100\text{ mm}/29.34\text{ mm}\times(0.25+0.22)\}=0$$
(as predicted)

the remainder is:

$$160\text{ gram}=F\times 50\text{ mm}/100\text{ mm}\times(0.25+0.22)=F\times\mathbf{0.235}$$

from this we get:

$$F=160\text{ gram}/0.235$$

$$F=680\text{ gram}$$

Figure 8:
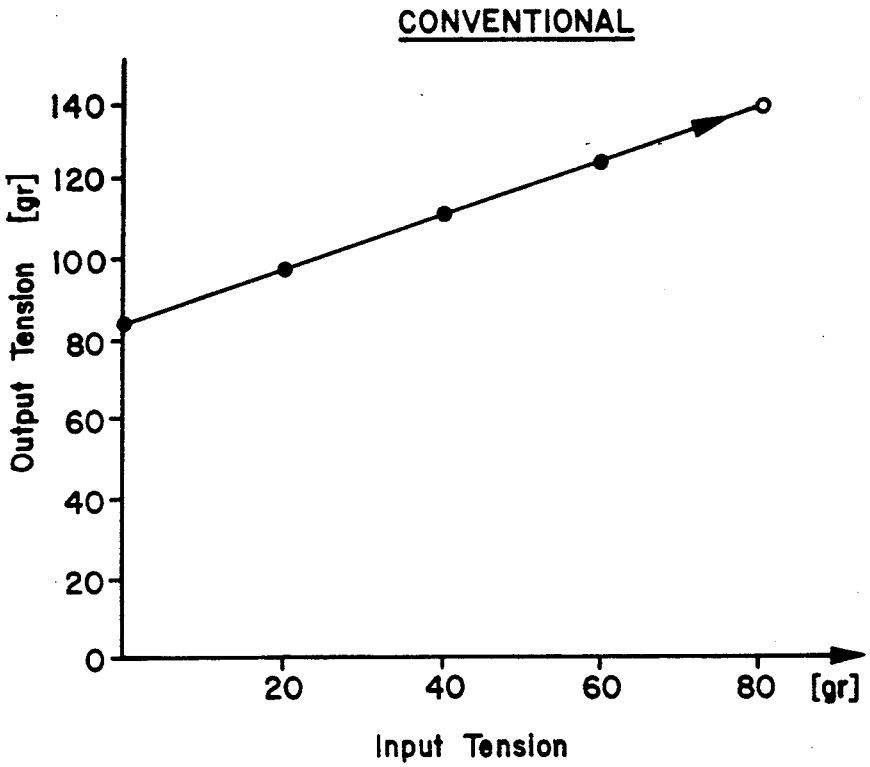
FIGS. 8 and 9 are correlation tables showing the relation of output tension to input tension in prior art methods and pursuant to the invention, respectively.
Figure 9:
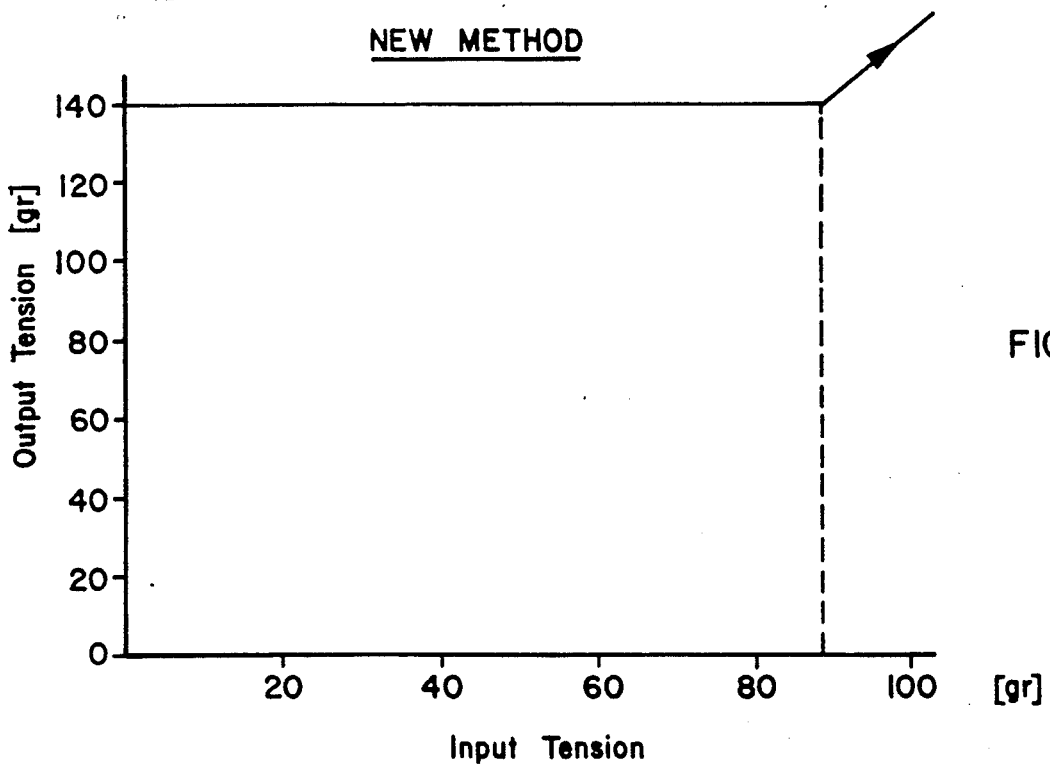

The conventional method which works in reverse (see FIG. 8) and does not allow for a complete tension equalization. In other words, the output tension is always a function (=is influenced) by the input tension.

Legend:

T1=Tension in yarn-strand from creel
T2=Tension in yarn-strand after tension shoe
T3=Tension in yarn-strand leaving device
F=Force for desired tension
G=Clamping force for yarn
a=lever length from pivot to end
b=lever length from pivot to applied tension force
c=lever length from pivot to tension shoe
u1=friction coefficient at clamp-shoe
u2=friction coefficient at lever, under clamp
u3=friction coefficient at 90 deg. bend Formula:

$$T3=(T1*c+F*b*(u1+u2))*e/(c+a*(u1+u2))*e$$

This formula has "T3=function of T1" which means that the output tension T3 depends on the input tension T1 and for this reason varies with fluctuations of the input tension.

To summarize, there are four types conditions of which are controlled as described above:

Condition 1—low or substantially no tension on the input yarn, where the lever arm 24 is up against the tension shoe 36. The slight amount of input tension is automatically subtracted from the yarn to a point approaching zero, where no tension is subtracted, and the tension on the yarn is "G."

Condition 2—higher input tension, where the input tension pulls the lever arm 24 downwardly to a corresponding degree, subtracting more tension from the yarn.

Figure 7:
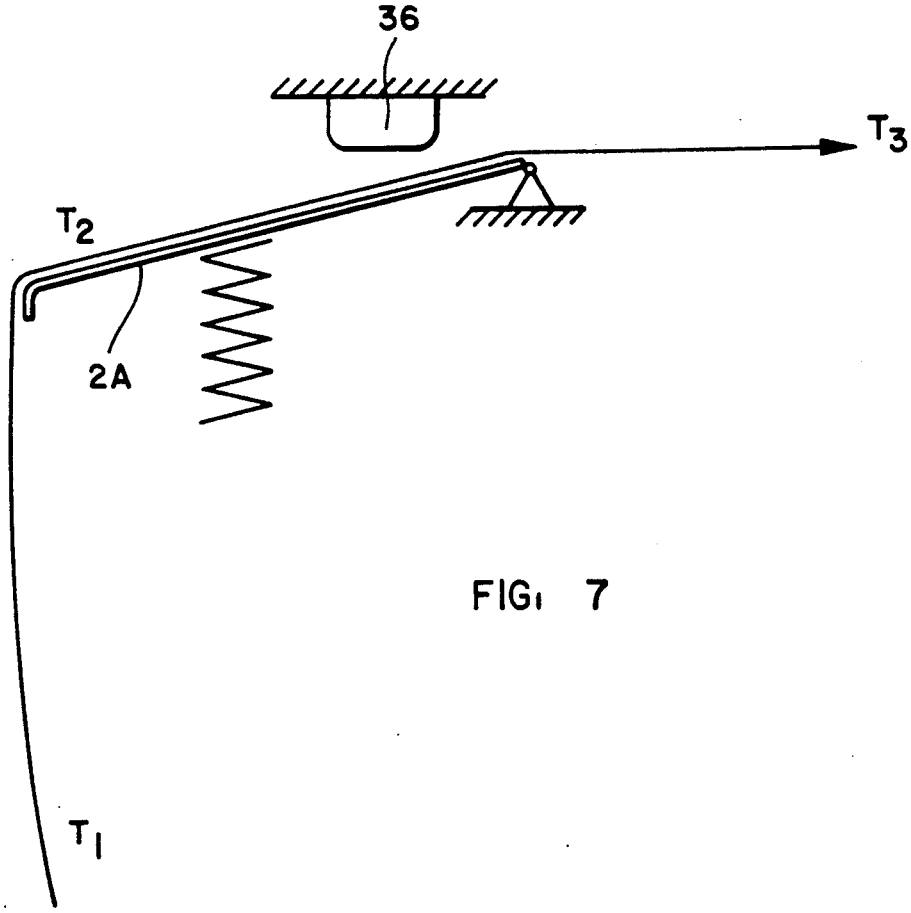
FIG. 7 is a schematic view of the strand tension controller as in FIG. 6 showing a different particular tension condition.

Condition 3—highest input tension, where lever arm 24 is pulled down to the point where shoe 36 does not contact the yarn and all of the tension is subtracted from the yarn. See FIG. 7.

Condition 4—the tension is so high that the input tension is greater than "G", at which point the tension level must be adjusted.

Tension adjustment can take place on two levels. Fine tension adjustments can be made by adjusting the air pressure regulating valve 18. The significance of this feature lies in the fact that an entire yarn processing machine or group of machines can be adjusted at once to a very high degree of accuracy and uniformity by a single adjustment. Indeed, an entire plant processing the same yarn can simultaneously control every yarn position on every machine in the plant if desired. Since the static pressure within air tube 16 is the same at all points, the pressure being exerted on each lever arm 24 are also the same.

For proper tension compensation the tension shoe 36 has to be adjusted by moving it into the proper holes 30-33. If the tension shoe 36 is too close to the pivot pin 25 the device overcompensates. Conversely, if the shoe 36 is too far away from pivot pin 25 the device does not compensate sufficiently.

A yarn controller is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A strand tension controller, comprising:

(a) an elongate strand sensing lever arm having a strand guiding input end and an opposing end downstream of the input end;

(b) friction means positioned between said input end and said opposing end of said lever arm for applying tension between a range of zero and a preset maximum tension on said strand;

(c) mounting means downstream of said friction means for mounting said lever arm for pivotal movement responsive to strand tension sensed at the strand engaging input end of said lever arm and for subtracting from the tension applied by said friction means the tension sensed on strand at the input end of said lever arm.

2. A strand tension controller according to claim 1, wherein said friction means comprises:

(a) a tension shoe for engaging a first surface of said lever arm and the strand passing along the top surface of said lever arm from the input to the opposing end of the lever arm; and (b) force means for cooperating with a second, opposing surface of said lever arm for urging said lever arm against said tension shoe.

3. A strand tension controller according to claim 2, wherein said force means comprises a pressure responsive expandable fluid reservoir.

4. A strand tension controller according to claim 3, wherein said fluid reservoir comprises a tube and includes pressure adjusting means for adjusting the pressure within said reservoir.

5. A strand tension controller according to claim 4, wherein said fluid comprises air.

6. A strand tension controller according to claim 3, 4 or 5, and including spacing means positioned between said fluid reservoir and said lever arm.

7. A strand tension controller according to claim 2 and including tension range adjustment means for adjusting the range of tension applied by said friction means.

8. A strand tension controller according to claim according to claim 7, wherein said tension range adjustment means comprises spacing means for positioning said tension shoe in a predetermined position from said pivoted tension subtraction means.

9. A yarn processing machine, comprising:

(a) a creel for holding a plurality of yarn packages in position to dispense yarn;

(b) a plurality of yarn processing stations for performing a predetermined process on the yarn dispensed from said creel;

(c) a plurality of take-up stations downstream from said yarn processing stations for holding a yarn take-up package to receive processed yarn;

(d) a like plurality of yarn tension controllers positioned downstream from said creel and upstream from said yarn processing stations for controlling tension of yarn delivered to said yarn processing stations, each of said yarn tension controllers comprising:

(i) an elongate strand sensing lever arm having a strand guiding input end and an opposing end downstream of the input end;

(ii) friction means positioned between said input end and said opposing end of said lever arm for applying tension between a range of zero and a preset maximum tension on said strand;

(iii) mounting means downstream of said friction means for mounting said lever arm for pivotal movement responsive to strand tension sensed at the strand engaging input end of said lever arm and for subtracting from the tension applied by said friction means the tension sensed on strand at the input end of said lever arm.

10. A yarn processing machine according to claim 9, wherein said friction means comprises:

(a) a tension shoe for engaging a first surface of said lever arm and the yarn passing along the top surface of said lever arm from the input to the opposing end of the lever arm; and (b) force means for cooperating with a second, opposing surface of said lever arm for urging said lever arm against said tension shoe.

11. A yarn processing machine according to claim 10, wherein said force means comprises a pressure responsive expandable fluid reservoir.

12. A yarn processing machine according to claim 11, wherein said fluid reservoir comprises a tube and includes pressure adjusting means for adjusting the pressure within said reservoir.

13. A yarn processing machine according to claim 12, wherein said fluid comprises air.

14. A yarn processing machine according to claim 11, 12 or 13, and including spacing means positioned between said fluid reservoir and said lever arm.

15. A yarn processing machine according to claim 12, wherein said tube extends in series relation to said plurality of yarn tension controllers for simultaneously and uniformly controlling the force applied to the yarn at each of said plurality of yarn tension controllers by the tension shoe.

16. A yarn processing machine according to claim 10 and including tension range adjustment means for adjusting the range of tension applied by said friction means.

17. A yarn processing machine according to claim according to claim 16, wherein said tension range adjustment means comprises spacing means for positioning said tension shoe in a predetermined position from said pivoted tension subtraction means.

18. A yarn processing machine, comprising:

(a) a creel for holding a plurality of yarn packages in position to dispense yarn;

(b) a plurality of yarn processing stations for performing a predetermined process on the yarn dispensed from said creel;

(c) a plurality of take-up stations downstream from said yarn processing stations for holding a yarn take-up package to receive processed yarn;

(d) a plurality of yarn tension controllers positioned downstream from said creel and upstream from said yarn processing stations for controlling tension of yarn delivered to said yarn processing stations, each of said yarn tension controllers comprising:

(i) a mounting tube mounted transverse to the direction of yarn travel from the creel to said yarn processing station and having an access opening therein;

(ii) an air pressure responsive expandable elongate air tube positioned through said mounting tube and extending along at least part of the length of the yarn processing machine and having air pressure adjustment means for simultaneously and uniformly controlling air pressure within said air tube and therefore the expansion of said tube in response to said air pressure;

(iii) a housing having an access opening therein, said housing mounted on said mounting tube with the access opening therein in communication with said access opening in said mounting tube;

(iv) a lever arm pivotally mounted in said housing in communication with the access opening in said housing and in communication with said mounting tube and having a first major surface for being engaged by said air tube, said lever arm having a second major surface along which said yarn passes, said lever arm also having a yarn engaging yarn input end and an opposing yarn output end, said lever arm being pivotally mounted intermediate said yarn output end and said yarn output end; and (v) a tension shoe carried by said housing for engaging said second major surface of said lever arm intermediate said yarn output end and the point of engagement by said air tube, the engagement by said tension shoe being in correlation to the force applied by said air tube to the first major surface of said lever arm, whereby an increase in input tension on the yarn results movement of said lever arm away from said tension shoe and therefore a corresponding subtraction of tension from the yarn.

19. A yarn processing machine according to claim 18, wherein said lever arm includes wear-resistant yarn guides proximate the input and output ends thereof.

20. A yarn processing machine according to claim 18, and including spacing means positioned in said mounting tube intermediate said air tube and said lever arm.

21. A yarn processing machine according to claim 18, and including a yarn threading slot in said housing for receiving a yarn therethrough.

22. A method of controlling strand tension in a strand processing machine, comprising the steps of:

(a) providing a creel, a strand processing station downstream from the creel and a strand take-up station downstream from the strand processing station;

(b) providing an elongate strand controller positioned between the creel and the strand processing station, said strand controller having a strand tension sensing lever arm with a strand guiding input end and an opposing end downstream of the input end; friction means positioned between said input end and said opposing end of said lever arm for applying tension between a range of zero and a preset maximum tension on said strand; and mounting means downstream of said friction means for mounting said lever arm for pivotal movement responsive to strand tension sensed at the strand engaging input end of said lever arm and for subtracting from the tension applied by said friction means the tension sensed on strand at the input end of said lever arm;

(c) applying a maximum desired pre-set tension to the strand by the friction means between the creel and the strand processing station;

(d) sensing the tension on the strand at the input end of the lever arm before application of the pre-set tension to the strand; and (e) reducing the maximum amount of pre-set tension applied to the strand by the friction means to the strand between the creel and the strand processing station by the amount of the tension sensed on the strand to maintain the maximum desired pre-set tension on the strand at the strand processing station.

23. A method of controlling strand tension in a strand processing machine according to claim 2, wherein the step of applying a maximum desired pre-set tension to the strand comprises applying friction to the strand in correlation to expansion of a fluid filled pressure reservoir.

24. A method of controlling strand tension in a strand processing machine according to claim 22 or 23, wherein the step of providing a creel, a strand processing station downstream from the creel and a strand take-up station downstream from the strand processing station comprises the step of providing a plurality of yarn creels, a plurality of yarn processing stations and a plurality of yarn take-up stations downstream from the yarn processing station for processing a plurality of yarn stands, and said strand processing machine comprises a textile yarn processing machine.

25. A method of controlling strand tension in a strand processing machine according to claim 24, wherein the step of applying a maximum desired pre-set tension to the yarn between the creel and the yarn processing station comprises applying said tension from a single fluid filled pressure reservoir in series to each of the yarn strands uniformly and simultaneously.

26. A method of controlling strand tension in a strand processing machine according to claim 25, wherein said fluid comprises air and said pressure reservoir comprises an elongate air tube extending from a single air source along said yarn processing machine from one end to the other end.

* * * * *